US008858349B2

(12) United States Patent
Vachon

(10) Patent No.: US 8,858,349 B2
(45) Date of Patent: Oct. 14, 2014

(54) PADDING LAYER FOR MULTI-LAYERED SPORTS PLAYING FIELD

(76) Inventor: Frédéric Vachon, Ste-Dorothée (CA)

( * ) Notice: Subject to any disclaimer, the term of this patent is extended or adjusted under 35 U.S.C. 154(b) by 102 days.

(21) Appl. No.: 13/807,345

(22) PCT Filed: Jun. 30, 2011

(86) PCT No.: PCT/CA2011/000771

§ 371 (c)(1),
(2), (4) Date: Dec. 28, 2012

(87) PCT Pub. No.: WO2012/000099

PCT Pub. Date: Jan. 5, 2012

(65) Prior Publication Data

US 2013/0102403 A1 Apr. 25, 2013

Related U.S. Application Data

(60) Provisional application No. 61/359,918, filed on Jun. 30, 2010.

(51) Int. Cl.

| | |
|---|---|
| ***A63C 19/10*** | (2006.01) |
| ***E01C 3/00*** | (2006.01) |
| ***A63C 19/04*** | (2006.01) |
| ***E01C 13/02*** | (2006.01) |
| *E01C 13/08* | (2006.01) |

(52) U.S. Cl.

CPC ..... *A63C 19/04* (2013.01); *E01C 2201/207* (2013.01); *E01C 3/006* (2013.01); *E01C 13/02* (2013.01); *E01C 2201/14* (2013.01); *E01C 13/08* (2013.01)

USPC ..... 472/92; 472/94; 428/17

(58) Field of Classification Search

USPC ..... 472/88, 89, 90, 92, 94; 428/17, 27

See application file for complete search history.

(56) References Cited

U.S. PATENT DOCUMENTS 6,800,339 B2 * 10/2004 Motz et al. ..... 428/17
6,877,932 B2 * 4/2005 Prevost ..... 405/38

(Continued)

FOREIGN PATENT DOCUMENTS

WO WO 2011074841 6/2011

OTHER PUBLICATIONS

PCT—International Search Report (ISR)—PCT/CA2011/000771 (Form PCT/ISA/210)—Sep. 27, 2011—3 pages.

*Primary Examiner* — Kien Nguyen

(74) *Attorney, Agent, or Firm* — Benoît & Côté Inc.

(57) ABSTRACT

The present document describes a padding layer for a multi-layered sports playing field. Various improvements are proposed for enhancing athlete's safety, surface hardness, water drainage, heat management, ease of assembly/installation, durability/longevity, uniformity, resistance to change in weather according to seasons, and stability. The improvements include: matching (multiple-wise) of spacing between rows of backstitches of the top layer and the drainage channels on top surface of the padding layer; a slit in the external tab portion of the padding layer panel, a slit near the lateral part of the tab or blank portion providing a hinging effect thereto, and/or protrusions at various positions on the tab or blank portions to account for change in size of the padding layer panel; drainage holes within the drainage channels; and various configurations of drainage channels on the bottom surface of the padding layer to improve evacuation of water toward the sides of the playing surface.

20 Claims, 6 Drawing Sheets

(56) References Cited

U.S. PATENT DOCUMENTS

| | | | | |
|---|---|---|---|---|
| 6,955,841 | B2 * | 10/2005 | Weghuis et al. | 428/17 |
| 6,989,179 | B2 * | 1/2006 | Prevost et al. | 428/17 |
| 7,357,966 | B2 | 4/2008 | Dipple | |
| 8,236,392 | B2 | 8/2012 | Sawyer et al. | |
| 2008/0176010 | A1 | 7/2008 | Sawyer | |
| 2012/0301638 | A1 | 11/2012 | Sawyer et al. | |

* cited by examiner

PADDING LAYER FOR MULTI-LAYERED SPORTS PLAYING FIELD

CROSS-REFERENCE TO RELATED APPLICATIONS

This application claims priority from U.S. provisional patent application No. 61/359,918 filed on Jun. 30, 2010.

BACKGROUND (a) Field

The subject matter disclosed generally relates to playing fields and more particularly to artificial sports playing fields.

(b) Related Prior Art

Present day sports playing fields are often made of a mix of natural and synthetic/artificial material. A base layer of dirt, gravel, sand or other suitable material is sometimes provided. An artificial padding layer may then be installed on top of which a layer of artificial grass is laid. The artificial grass construction is very similar to most types of industrially-made carpets and can be filled or not with material like SBR, EPDM, TPE, coated sand, sand or other infill material.

The design consideration for sports playing fields include: athlete's safety, surface hardness, water drainage, heat management, ease of assembly/installation, durability/longevity, uniformity, resistance to change in weather according to seasons, stability, etc.

The playing field described herein was developed keeping all such factors in mind.

SUMMARY

There is described herein a padding layer for a multi-layered sports playing field. Various improvements are proposed for enhancing athlete's safety, surface hardness, water drainage, heat management, ease of assembly/installation, durability/longevity, uniformity, resistance to change in weather according to seasons, and stability. The improvements include: matching (multiple-wise) of spacing between rows of backstitches of the top layer and the drainage channels on top surface of the padding layer; a slit in the external tab portion of the padding layer panel, a slit near the lateral part of the tab or blank portion providing a hinging effect thereto, and/or protrusions at various positions on the tab or blank portions to account for change in size of the padding layer panel; drainage holes within the drainage channels; and various configurations of drainage channels on the bottom surface of the padding layer to improve evacuation of water toward the sides of the playing surface.

According to an embodiment, there is provided a padding layer panel for assembly with other substantially identical padding layer panels for forming a padding layer for installation over a surface and under a carpet-like top layer having a series of regularly spaced apart parallel rows of backstitches separated by a backstitch distance. The padding layer panel comprises: a top surface comprising top channels which are equally spaced and parallel, each one of the top channels having a center, wherein a distance between centers of adjacent ones of the top channels is defined as a channel distance, wherein the channel distance is a multiple of the backstitch distance, and wherein each one of the top channels is for receiving the same number of rows of backstitches; and two opposite edges, wherein at least a portion of the top channels extend between one of the two opposite edges to the other one of the two opposite edges.

According to another embodiment, the at least a portion of the top channels are perpendicular to both opposite edges and extend from one of the two opposite edges to the other one of the two opposite edges.

According to another embodiment, the padding layer panel further comprises a bottom surface comprising main drainage channels which are equally spaced and parallel, the main drainage channels extending in a direction of a slope of the surface thereby facilitating fluid evacuation via the main drainage channels.

According to another embodiment, the padding layer panel further comprises openings from the at least some of the top channels to at least some of the main drainage channels.

According to another embodiment, the openings from the top channels to the main drainage channels are straight and circular.

According to another embodiment, the diameter of the openings is in the range from about 0.250" to about 0.500".

According to another embodiment, the bottom surface further comprises secondary drainage channels extending non-perpendicularly between the main drainage channels.

According to another embodiment, the secondary drainage channels make a 30 to 65 degree angle with the main drainage channels.

According to another embodiment, the dimensions of the main drainage channels and the secondary drainage channels comprise a depth and a width wherein the depth and the width are in the range from about 0.25 cm to about 2.0 cm.

According to another embodiment, the channel distance is in the range from about 3/64" to about 3/4".

According to another embodiment, the thickness of the padding layer panel is normally uniform and is in the range from about 0.25" to about 6".

According to another embodiment, the padding layer panel comprises one of: an expanded polypropylene (EPP), an hybrid expanded polypropylene EPP (HEPP), a mix of an expanded polypropylene (EPP) with an expanded polyethylene (EPE) or polyethylene (PE), and a rubber material.

According to another embodiment, the padding layer comprises a closed-cell structure made with closed-cell beads.

According to another embodiment, the padding layer panel further comprises interlocking tab (male) and blank (female) portions, the tab portions having a straight external edge and a protrusion extending from the straight external edge to ensure a minimal spacing between two adjacent padding layer panels, the protrusion thereby absorbing expansion of the padding layer panel.

According to another embodiment, a height and a width of the protrusion is in the range from about 0.125" to about 0.500".

According to another embodiment, the padding layer panel further comprises comprising interlocking tab (male) and blank (female) portions, the tab portions having a lateral edge and a protrusion extending from the lateral edge to ensure a minimal spacing between two adjacent padding layer panels, the protrusion thereby absorbing contraction of the padding layer panel.

According to another embodiment, the padding layer panel further comprises interlocking tab (male) and blank (female) portions, the tab portions having a straight external edge comprising a slit to account for expansion of the padding layer panel.

According to another embodiment, the padding layer panel further comprises interlocking tab (male) and blank (female) portions, the tab portions having a straight external edge and a lateral edge, the straight external edge comprising a slit in an area near the lateral edge to form a hinged portion capable of absorbing contraction of the padding layer panel.

According to an embodiment, there is provided a multi-layered sports playing field comprising: a carpet-like top layer having a series of regularly spaced apart parallel rows of backstitches separated by a backstitch distance; and a padding layer for installation under the carpet-like top layer. The padding layer comprises a top surface comprising top channels which are equally spaced and parallel, each one of the top channels having a center, wherein a distance between centers of adjacent ones of the top channels is defined as a channel distance, wherein the channel distance is a multiple of the backstitch distance, and wherein each one of the top channels is for receiving the same number of rows of backstitches.

According to an embodiment, there is provided a padding layer for installation under a carpet-like top layer having a series of regularly spaced apart parallel rows of backstitches separated by a backstitch distance. The padding layer comprises a top surface comprising top channels which are equally spaced and parallel, each one of the top channels having a center, wherein a distance between centers of adjacent ones of the top channels is defined as a channel distance, wherein the channel distance is a multiple of the backstitch distance, and wherein each one of the top channels is for receiving the same number of rows of backstitches.

According to an embodiment, there is provided a padding layer for a multi-layered sports playing field, the padding layer for installation under a carpet-like top layer having a series of regularly spaced apart parallel rows of backstitches separated by a given distance, the padding layer comprising: a top surface comprising regularly spaced apart parallel top drainage channels separated by a given distance, wherein the given distance separating the top drainage channels is a multiple of the given distance separating the rows of backstitches whereby at least one of the rows of backstitches will always fall in each of the channels.

According to another embodiment, there is provided a padding layer panel for use in forming a padding layer for a multi-layered sports playing field, the padding layer panel comprising: interlocking tab (male) and blank (female) portions, the tab portions having a straight external edge comprising a slit to account for expansion of the at least one of the tab portions.

According to another embodiment, there is provided a padding layer panel for use in forming a padding layer for a multi-layered sports playing field, the padding layer panel comprising: interlocking tab (male) and blank (female) portions, the tab portions having a straight external edge and a protrusion extending from the straight external edge to ensure a minimal spacing between two adjacent padding layer panels, the protrusion thereby absorbing the expansion of the padding layer panel.

According to another embodiment, there is provided a padding layer panel for use in forming a padding layer for a multi-layered sports playing field, the padding layer panel comprising: interlocking tab (male) and blank (female) portions, the tab portions having a lateral edge and a protrusion extending from the lateral edge to ensure a minimal spacing between two adjacent padding layer panels, the protrusion thereby absorbing the contraction of the padding layer panel.

According to another embodiment, there is provided a padding layer panel for use in forming a padding layer for a multi-layered sports playing field, the padding layer panel comprising: interlocking tab (male) and blank (female) portions, the tab portions having a straight external edge and a lateral edge, the straight external edge comprising a slit in an area near the lateral edge to form a hinged portion capable of absorbing the contraction of the padding layer panel.

According to another embodiment, there is provided a padding layer for a multi-layered sports playing field, the padding layer comprising: a top surface comprising top drainage channels; a bottom surface comprising bottom drainage channels; and openings from the top drainage channels to the bottom drainage channels.

According to another embodiment, there is provided a padding layer for a multi-layered sports playing field having sides and a middle portion therebetween, the sides of the playing field being lower than the middle portion to ensure proper water drainage, the padding layer for installation under a carpet-like top layer having a series of regularly spaced apart parallel backstitches separated by a given distance, the padding layer comprising: a bottom surface comprising regularly spaced apart parallel main drainage channels, the main drainage channels extending from side-to-side of the playing field.

According to another embodiment, there is provided a padding layer disclosed above wherein the bottom surface further comprises secondary drainage channels extending non-perpendicularly between the main drainage channels.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
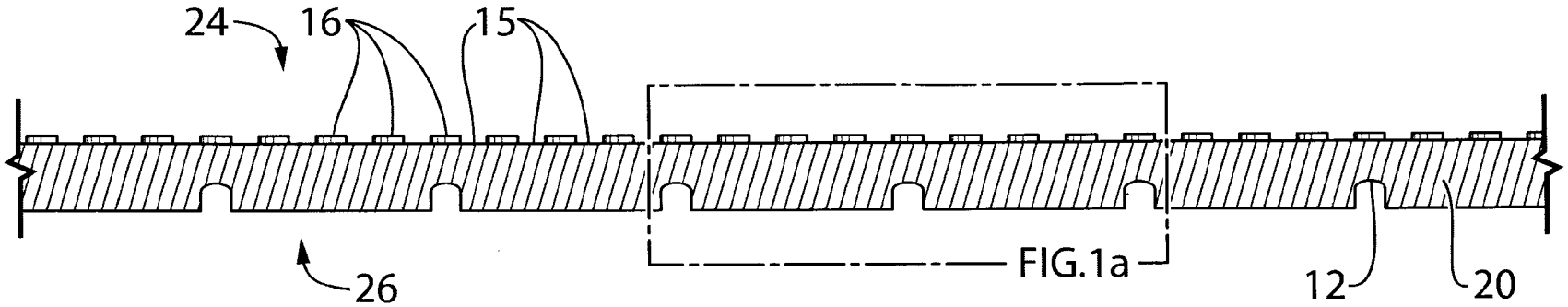
FIG. 1 is a partial cutout elevation view illustrating the padding layer according to an embodiment of the present disclosure.
Figure 1A:
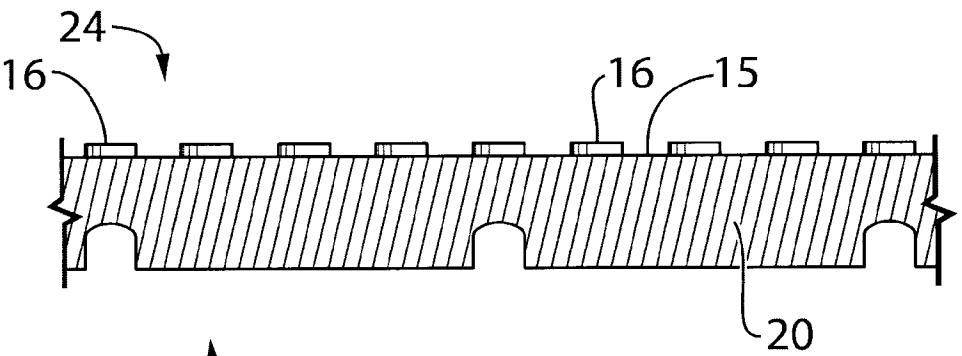
FIG. 1*a* is a partial cutout elevation view of a portion of FIG. 1.

Referring now to the drawings, and more particularly to FIGS. 1, 1*a*, 2*a*, 2*b*, 2*b*, and 5, an embodiment of a padding layer 20 is shown. Padding layer 20 is adapted for a multi-layered sports playing field 30. The padding layer 20 is for installation under a carpet-like top layer 22 and over a surface (not shown) which may include a base layer (not shown) of dirt, gravel, sand or other suitable material.

The carpet-like top layer 22 has a series of regularly spaced apart (or equally spaced) parallel rows of backstitches 1*a*, 1*b*, 1*c* separated by a backstitch distance 23.

The padding layer 20 comprises a top surface 24 which comprises equally spaced parallel top channels 15 separated by a channel distance 21. The channel distance 21 is the distance between centers of adjacent channels. The channel distance 21 separating the top channels 15 is a multiple of the backstitch distance 23 separating the rows of backstitches 1*a*, 1*b*, 1*c* whereby at least one of the rows of backstitches 1*a*, 1*b*, 1*c* will always fall in each of the top channels 15. In fact, each one of the top channels 15 is for receiving the same number of rows of backstitches 1*a*, 1*b*, 1*c*.

This fact that at least one of the rows of backstitches 1*a*, 1*b*, 1*c* will always fall in each of the top channels 15 is very useful for preventing slippage of the carpet-like top layer 22 relative to the padding layer 20 in a direction perpendicular to the longitudinal direction of the row of backstitches 1*a*, 1*b*, 1*c*.

The top channels 15 are also useful for drainage or evacuation of water from the surface of the multi-layered sports playing field 30.

The thickness of the padding layer 20 is normally uniform and may range between 0.25" to 6". The material of the padding layer 20 can be Expanded Polypropylene (EPP). In another embodiment, the material of the padding layer 20 can be an Hybrid EPP (HEPP), which is a mix of a EPP with an expanded Polyethylene (EPE), a Polyethylene (PE), a rubber material, a recyclable material or another suitable material to maximize the hardness-flexibility ratio. According to an embodiment, the padding layer 20 is a closed-cell structure made with closed-cell beads.

According to an embodiment, the channel distance 21 separating the top channels 15 is ¾". In such an embodiment, the top channels 15 can accommodate a backstitch distance 23 separating the rows of backstitches 1*a*, 1*b*, 1*c* of ¾", ⅜", 3/16", etc. Of course, it is understood that if the rows of backstitches 1*a*, 1*b*, 1*c* are distanced according to another standard measure, e.g., 20 mm, 10 mm, 5 mm, etc, top surface 24 will be made with a channel distance 21 separating the top channels 15 which is a multiple thereof such as 20 mm. The depth of the top channels 15 may vary between 1 mm and 4 mm. The height of a divider 16 therefore corresponds to the depth of the top channels 15. According to an exemplary embodiment, the width of the top channels 15 is 5 to 20 mm.

Figure 2A:
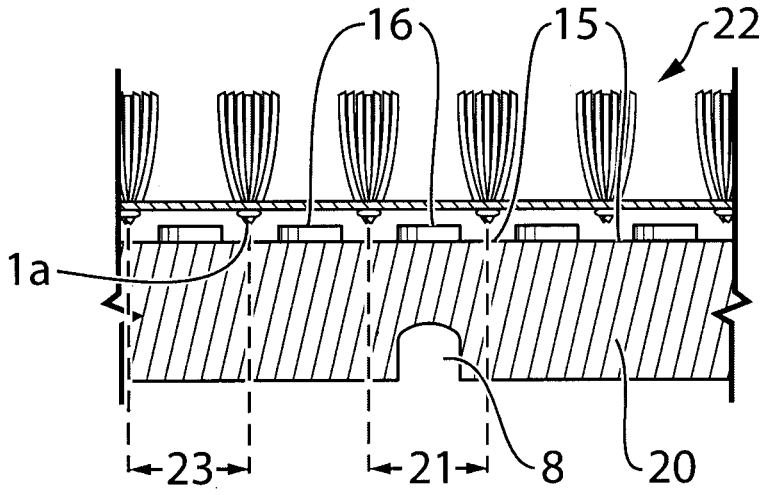
FIGS. 2*a*, 2*b*, and 2*c* are a partial cutout elevation view illustrating the padding layer according to embodiments of the present disclosure on which is laid a top layer made of substantially artificial material simulating a natural playing surface such as grass.

As shown in FIG. 2*a*, for a backstitch distance 23 of ¾", each backstitch 1*a* will fall in a separate top channel 15 while no backstitches 1*a* fall on a divider 16.

Figure 2B:
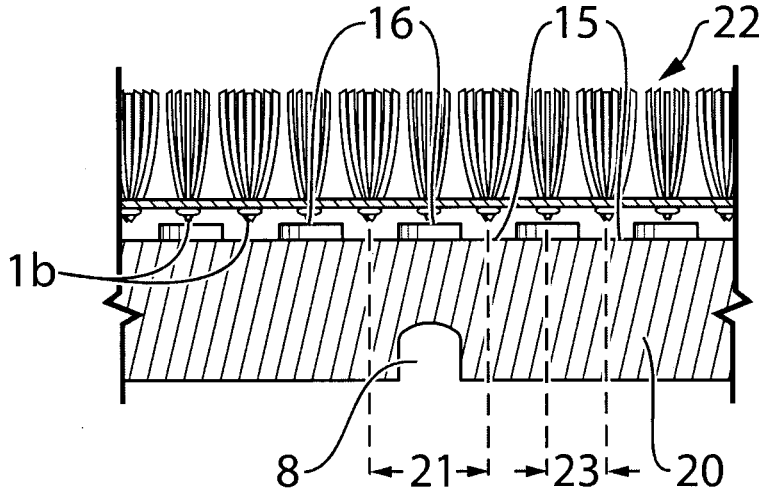

As shown in FIG. 2*b*, for a backstitch distance 23 of ⅜", one backstitch 1*b* will fall in a separate top channel 15 and one backstitch 1*b* will be aligned with a divider 16.

Figure 2C:
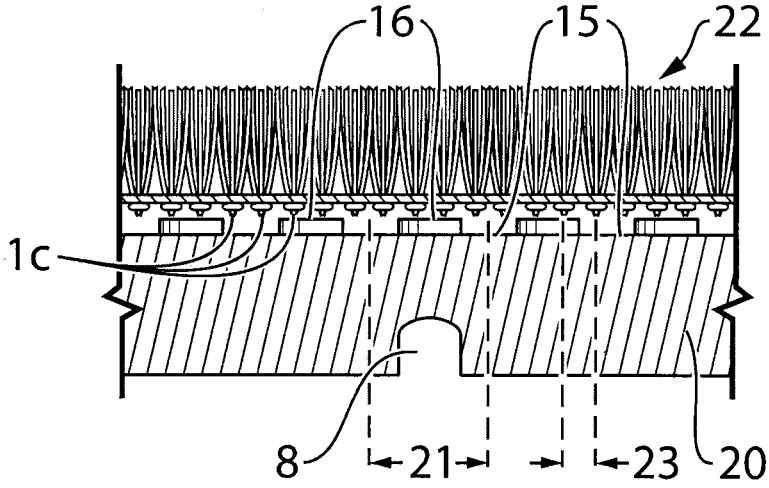

As shown in FIG. 2*c*, for a backstitch distance 23 of 3/16", two backstitches 1*c* will fall in a separate top channel 15 and two backstitches 1*c* will be aligned with a divider 16.

Figure 5:
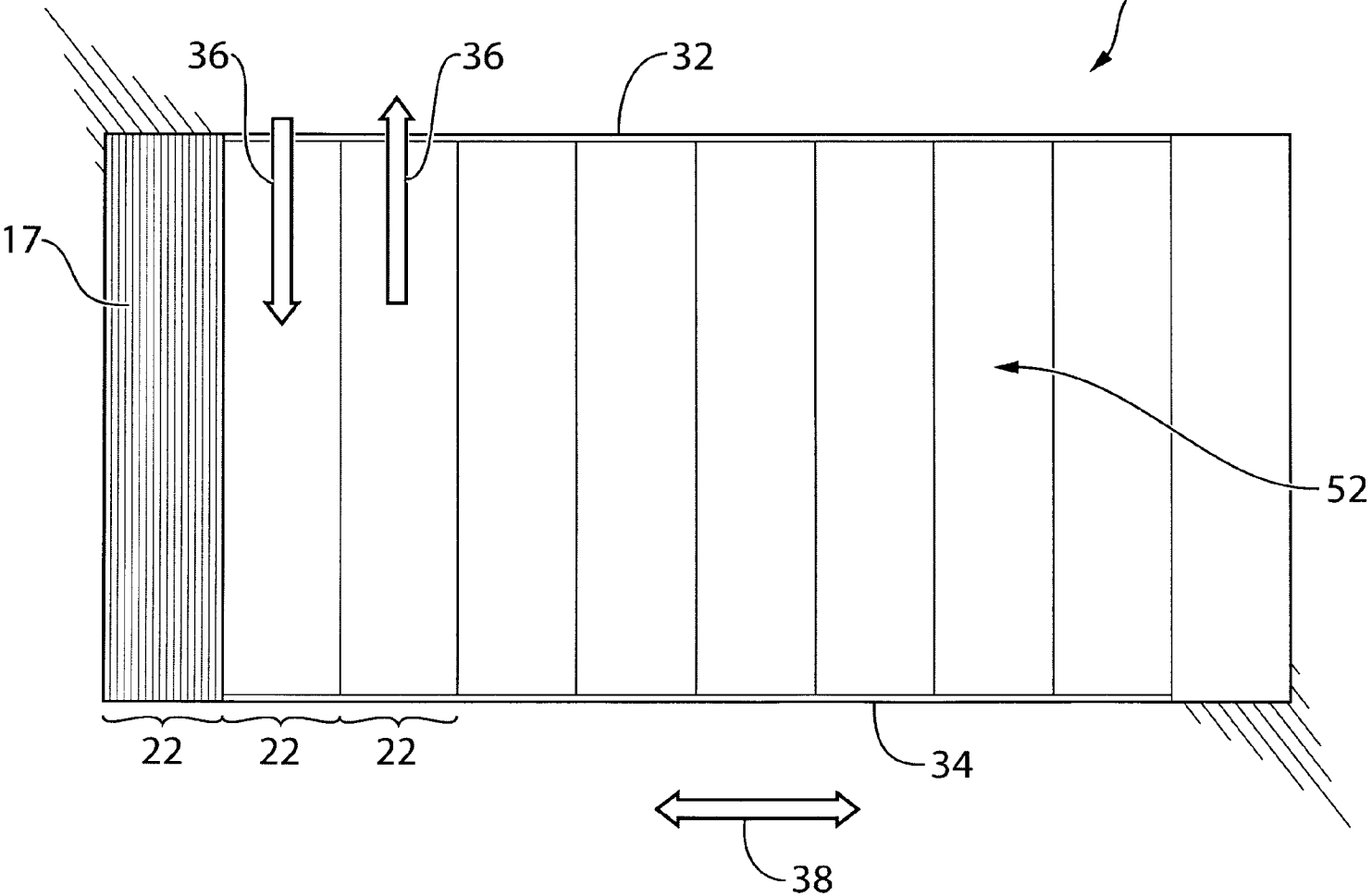
FIG. 5 is a schematic view of a playing field view from above according to an embodiment of the disclosure.

As shown in FIG. 5, rolls of carpet-like top layer 22 are laid down on playing field 30 according to a roll direction 36. In this embodiment, the direction 17 of rows of backstitches which correspond to the roll direction 36 extend from one side 32 to the other side 34 of the playing field 30. The sides 32, 34 of the playing field 30 are lower than a middle portion 52 to ensure proper water drainage and evacuation.

Since most often the play of a game on such playing field 30 occurs in play direction 38, the divider 16 (FIG. 2) will greatly interfere with movement of the rows of backstitches 1*a*, 1*b*, 1*c* and hence with movement of the rolls of carpet-like top layer 22 in the direction of play 38.

Figure 4:
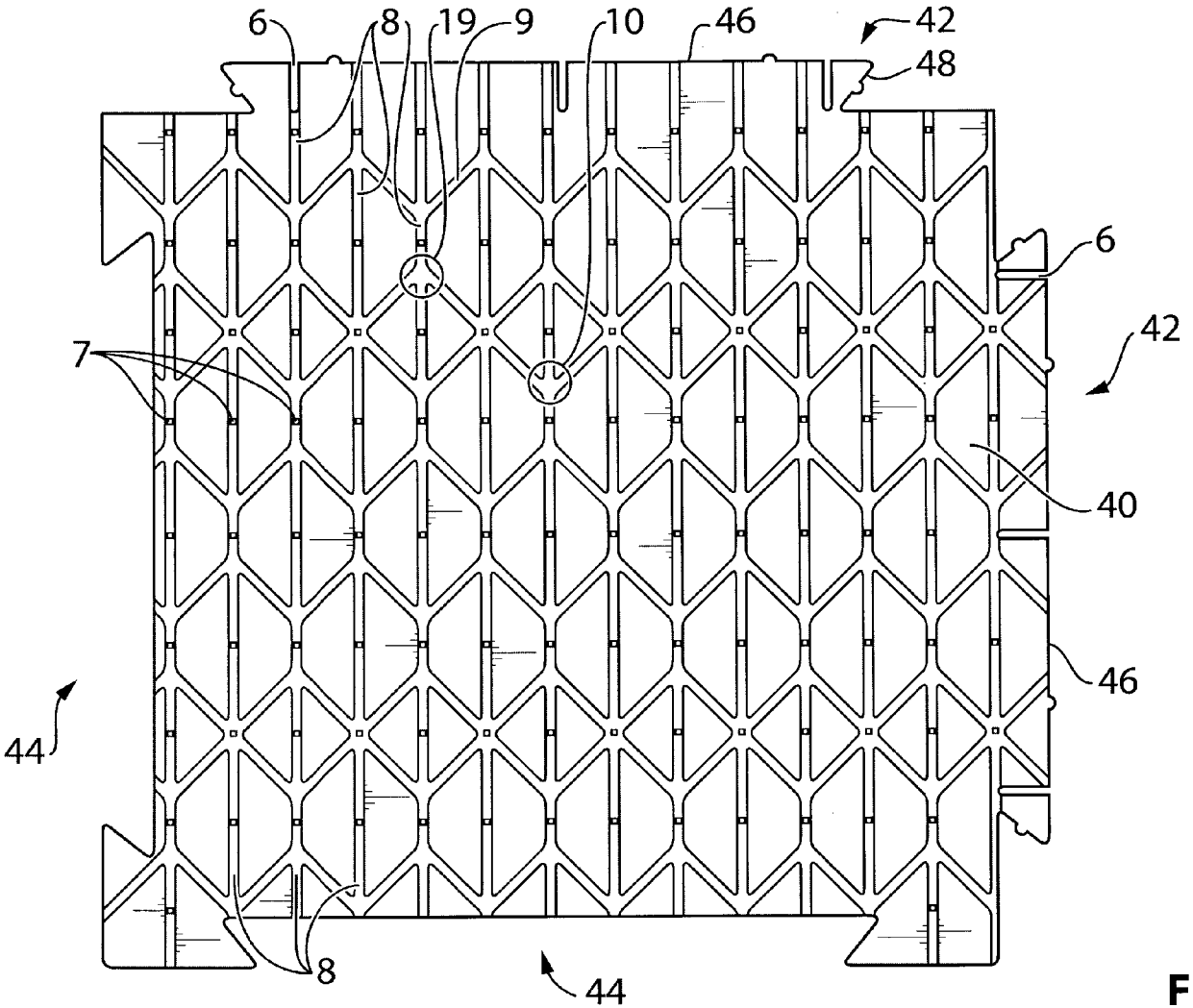
FIG. 4 is a bottom plan view of the one interlocking padding layer panel according to an embodiment.

Now turning to FIG. 4, according to another embodiment, the padding layer 20 comprises a bottom surface 26 which comprises regularly/equally spaced apart parallel main drainage channels 8. The main drainage channels 8 extending from side-to-side of the playing field 30.

According to another embodiment, the bottom surface 26 further comprises secondary drainage channels 9 extending non-perpendicularly between the main drainage channels 8. According to an embodiment, the dimensions of the main drainage channels 8 and the secondary drainage channels 9 ranges between a depth of 0.25 cm to 2 cm and a width of 0.25 cm to 2 cm. Examples of depth and width are 0.25 cm×0.25 cm, 2.0 cm×2.0 cm, 0.5 cm×0.5 cm, 1.0 cm×1.0 cm and 0.25×2 cm. The depth and width are not necessarily of equal dimension.

According to another embodiment, the secondary drainage channels 9 make a 30 to 65 degree angle with the main drainage channels 8. According to another embodiment, the secondary drainage channels 9 make a 45 degree angle with the main drainage channels 8. Other angles are also possible as long as water drainage is possible. The secondary drainage channels 9 are positioned at mirror angles 10 and 19 to enable drainage from the middle portion 52 to both sides 32 and 34. The installers of the padding layer panels 40 (see FIGS. 3 and 4) therefore only have to ensure that the main drainage channels 8 are installed perpendicularly to the play direction 38.

Figure 3:
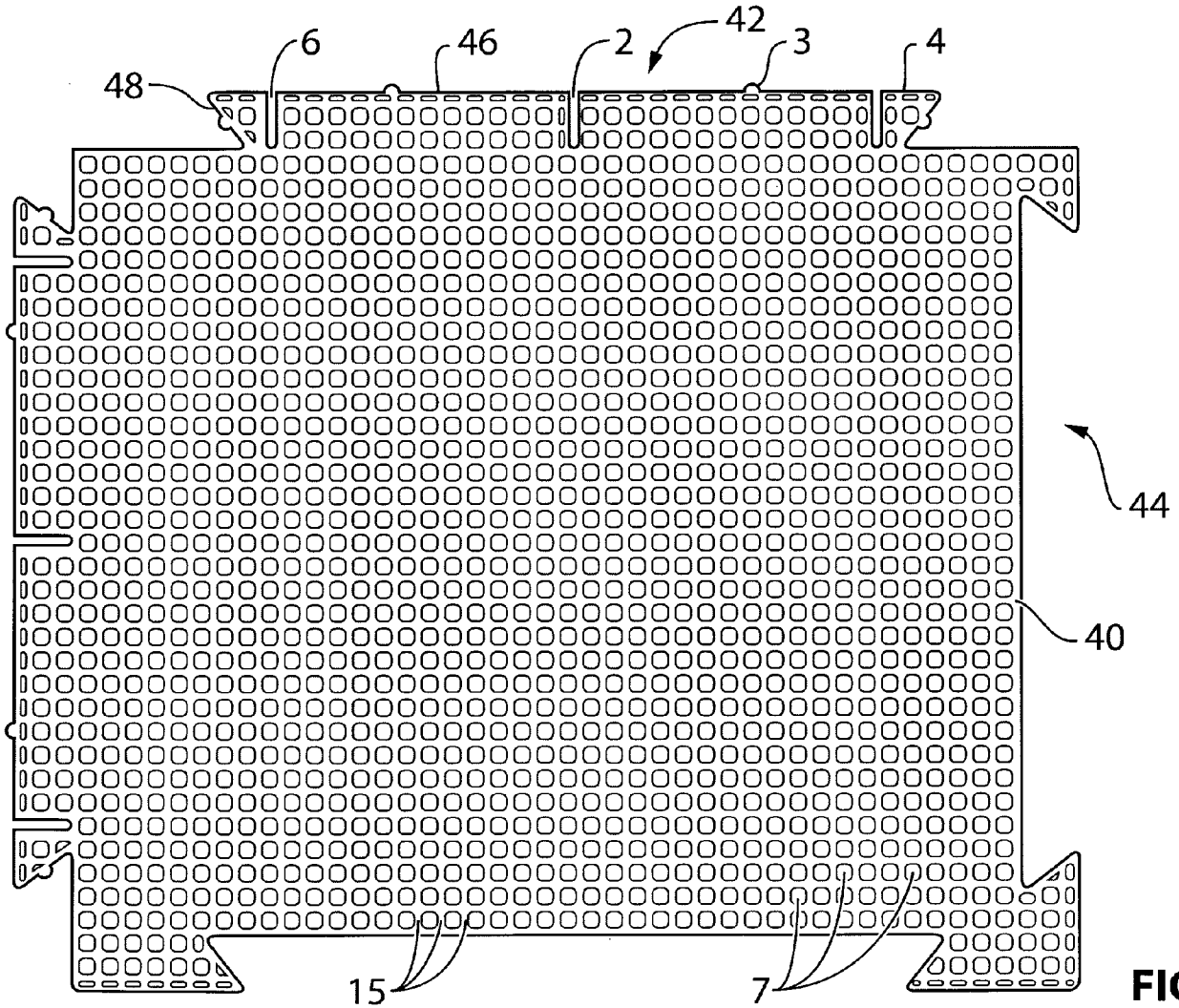
FIG. 3 is a top plan view of one interlocking padding layer panel according to an embodiment of which many are joined together to make the padding layer.
Figure 3A:
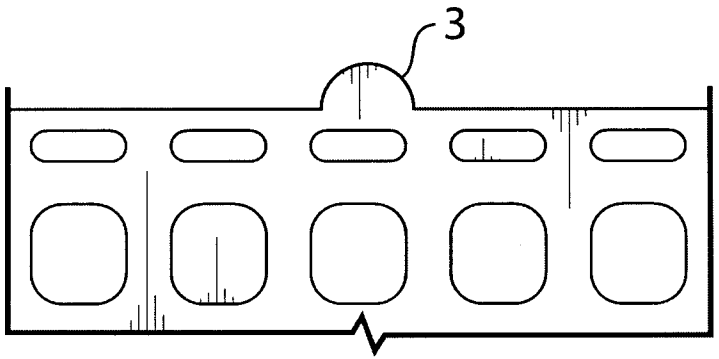
FIG. 3*a* is a close-up view of a protrusion on the side of the interlocking padding layer panel of FIG. 3.

Now referring to FIGS. 3, 3*a*, and 4, an embodiment of a padding layer panel 40 is shown. The padding layer panel 40 is for use in forming a padding layer (see previous figures) for a multi-layered sports playing field 30 (see FIG. 5). The padding layer panel 40 comprises interlocking tab (male) 42 and blank (female) 44 portions. The tab portions 42 have a straight external edge 46 comprising a slit 2 to account for expansion of the at least one of the tab portions 42. Expansion will occur due to an increase in temperature (hot weather). According to an embodiment, the width of the slit 2 is between 5 mm to 25 mm.

According to another embodiment, the padding layer panel 40 comprises interlocking tab (male) 42 and blank (female) 44 portions. The tab portions 42 has a straight external edge 46 and a protrusion 3 extending from the straight external edge 46 to ensure a minimal spacing between two adjacent padding layer panels 40. The protrusion 3 may thereby absorb the expansion of the padding layer panel 40. According to an embodiment, the protrusion 3 has a height and a width in a range of about 0.125" to 0.500". According to another embodiment, the protrusion 3 has a height in a range of about 0.125" to 0.250" and a width in a range of about 0.250" to 0.500".

According to another embodiment, the padding layer panel 40 comprises interlocking tab (male) 42 and blank (female) 44 portions. The tab portions 42 have a lateral edge 48 and a protrusion 4 extending from the lateral edge 48 to ensure a minimal spacing between two adjacent padding layer panels 40. The protrusion 4 thereby absorbing the contraction of the padding layer panel. Contraction will occur due to a decrease in temperature (cold weather). According to an embodiment, the protrusion 4 has a height in a range of 0.125" to 0.250" and a width in a range of 0.250" to 0.500".

According to another embodiment, the padding layer panel 40 comprises interlocking tab (male) 42 and blank (female) 44 portions. The tab portions 42 having a straight external edge 46 and a lateral edge 48. The straight external edge 46 comprises a slit 6 in an area near the lateral edge 48 to form a hinged portion capable of absorbing the contraction of the padding layer panel 40. According to an embodiment, the width of the slit 6 is between 5 mm to 25 mm.

According to another embodiment, the padding layer 20 could be provided in a roll form instead of a panel form. The thickness and flexibility determine the feasibility of providing the padding layer 20 in a roll or in a panel form.

Now returning to FIGS. 1, 1*a*, 3, 4 and 5, there is shown another embodiment of a padding layer 20 for a multi-layered sports playing field 30. The padding layer 20 comprises a top surface 24 which comprises top channels 15. The padding layer 20 further comprises a bottom surface 26 which comprises main drainage channels 8. The padding layer 20 further comprises openings 7 from the top channels 15 to the main drainage channels 8. According to an embodiment, the openings are circular and their diameter ranges between 0.250" and 0.500".

According to an embodiment, the main drainage channels 8 are vertically aligned with a divider 16 to increase the rigidity of the padding layer panels 40. To further increase the rigidity of the padding layer panels 40, an arch or angled shaped 12 is provided at the top of the main drainage channels 8.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A padding layer panel for assembly with other substantially identical padding layer panels for forming a padding layer for installation over a surface and under a carpet-like top layer having a series of regularly spaced apart parallel rows of backstitches separated by a backstitch distance, the padding layer panel comprising:

a top surface comprising top channels which are equally spaced and parallel, each one of the top channels having a center, wherein a distance between centers of adjacent ones of the top channels is defined as a channel distance, wherein the channel distance is a multiple of the backstitch distance, and wherein each one of the top channels is for receiving the same number of rows of backstitches; and two opposite edges, wherein at least a portion of the top channels extend between one of the two opposite edges to the other one of the two opposite edges and at least one of the two opposite edges is adapted for attachment to one of the other substantially identical padding layer panels.

2. The padding layer panel of claim 1, wherein the at least a portion of the top channels are perpendicular to both opposite edges and extend from one of the two opposite edges to the other one of the two opposite edges.

3. The padding layer panel of claim 1, further comprising a bottom surface comprising main drainage channels which are equally spaced and parallel, the main drainage channels extending in a direction of a slope of the surface thereby facilitating fluid evacuation via the main drainage channels.

4. The padding layer panel of claim 3, further comprising openings from the at least some of the top channels to at least some of the main drainage channels.

5. The padding layer panel of claim 4, wherein the openings from the top channels to the main drainage channels are straight and circular.

6. The padding layer panel of claim 5, wherein the diameter of the openings is in a range from about 0.250" to about 0.500".

7. The padding layer panel of claim 3, wherein the bottom surface further comprises secondary drainage channels extending non-perpendicularly between the main drainage channels.

8. The padding layer panel of claim 7, wherein the secondary drainage channels make a 30 to 65 degree angle with the main drainage channels.

9. The padding layer panel of claim 8, wherein the dimensions of the main drainage channels and the secondary drainage channels comprise a depth and a width wherein the depth and the width are in a range from about 0.25 cm to about 2.0 cm.

10. The padding layer panel of claim 1, wherein the channel distance is in a range from about 3/64" to about 3/4".

11. The padding layer panel of claim 1, wherein the thickness of the padding layer panel is normally uniform and is in a range from about 0.25" to about 6".

12. The padding layer panel of claim 1, wherein the padding layer panel comprises one of: an expanded polypropylene (EPP), an hybrid expanded polypropylene EPP (HEPP), a mix of an expanded polypropylene (EPP) with an expanded polyethylene (EPE) or polyethylene (PE), and a rubber material.

13. The padding layer panel of claim 1, wherein the padding layer panel comprises a closed-cell structure made with closed-cell beads.

14. The padding layer panel of claim 1, further comprising interlocking tab (male) and blank (female) portions, the tab portions having a straight external edge and a protrusion extending from the straight external edge to ensure a minimal spacing between two adjacent padding layer panels, the protrusion thereby absorbing expansion of the padding layer panel.

15. The padding layer panel of claim 14, wherein a height and a width of the protrusion is in a range from about 0.125" to about 0.500".

16. The padding layer panel of claim 1, further comprising interlocking tab (male) and blank (female) portions, the tab portions having a lateral edge and a protrusion extending from the lateral edge to ensure a minimal spacing between two adjacent padding layer panels, the protrusion thereby absorbing contraction of the padding layer panel.

17. The padding layer panel of claim 1, further comprising interlocking tab (male) and blank (female) portions, the tab portions having a straight external edge comprising a slit to account for expansion of the padding layer panel.

18. The padding layer panel of claim 1, further comprising interlocking tab (male) and blank (female) portions, the tab portions having a straight external edge and a lateral edge, the straight external edge comprising a slit in an area near the lateral edge to form a hinged portion capable of absorbing contraction of the padding layer panel.

19. A multi-layered sports playing field comprising:

a carpet-like top layer having a series of regularly spaced apart parallel rows of backstitches separated by a backstitch distance; and a padding layer for installation under the carpet-like top layer, the padding layer comprising:

a top surface comprising top channels which are equally spaced and parallel, each one of the top channels having a center, wherein a distance between centers of adjacent ones of the top channels is defined as a channel distance, wherein the channel distance is a multiple of the backstitch distance, and wherein each one of the top channels is for receiving the same number of rows of backstitches.

20. A padding layer for installation under a carpet-like top layer having a series of regularly spaced apart parallel rows of backstitches separated by a backstitch distance, the padding layer comprising:

a top surface comprising top channels which are equally spaced and parallel, each one of the top channels having a center, wherein a distance between centers of adjacent ones of the top channels is defined as a channel distance, wherein the channel distance is a multiple of the backstitch distance, and wherein each one of the top channels is for receiving the same number of rows of backstitches.

* * * * *